United States Patent [19]

Chellis

[11] 4,118,943

[45] Oct. 10, 1978

[54] REFRIGERATION SYSTEM WITH MAGNETIC LINKAGE

[75] Inventor: Fred Freeman Chellis, Concord, Mass.

[73] Assignee: Cryogenic Technology, Inc., Waltham, Mass.

[21] Appl. No.: 665,848

[22] Filed: Mar. 17, 1976

[51] Int. Cl.[2] ..... F25B 9/00

[52] U.S. Cl. ..... 62/6; 74/44; 74/110; 251/65; 403/404; 403/DIG. 1

[58] Field of Search ..... 62/6; 403/404, DIG. 1; 74/44, 110; 251/65

[56] References Cited

U.S. PATENT DOCUMENTS

| | | | |
|---|---|---|---|
| 3,275,011 | 2/1966 | Berezansky et al. | 251/65 |
| 3,423,948 | 1/1969 | Cowans | 62/6 |
| 3,523,427 | 8/1970 | Simpson | 62/6 |
| 3,933,000 | 1/1976 | Doody | 62/6 |

*Primary Examiner*—Ronald C. Capossela
*Attorney, Agent, or Firm*—Griffin, Branigan and Butler

[57] ABSTRACT

A vuilleumier-cycle refrigeration system of the type including first and second communicating, sealed, cylindrical, vessels having first and second displacers respectively mounted therein in sliding, sealing contact with the inner walls thereof, includes magnetic linkage between the two displacers for driving the displacers within the sealed vessels without contaminating the sealed vessels. With regard to the magnetic linkage, there are smaller, auxiliary cylindrical vessels coupled respectively to the first and second vessels, having smaller diameters, and thinner walls than the first and second vessels. Rods attached to the displacers and extending into the auxiliary vessels have magnetic material followers attached thereto. Magnetic-material drivers are moveable along the auxiliary vessels, opposite the followers, to thereby attract and move the magnetic-material followers and their attached displacers.

15 Claims, 6 Drawing Figures

REFRIGERATION SYSTEM WITH MAGNETIC LINKAGE

BACKGROUND OF THE INVENTION

This invention relates broadly to refrigeration systems, and more particularly to refrigeration systems having reciprocating displacers in cylindrical pressurized vessels, such a Vuilleumier-cycle apparatus.

Many refrigeration systems employ an elongated, cylindrical vessel having a displacer slideably mounted therein making sealing contact with the inner wall thereof. In such systems a regenerator is often coupled between opposite ends of the elongated cylindrical vessel so that, when the displacer is moved toward one or the other end of the vessel, refrigerant fluid therein is driven through the regenerator to the opposite end of the elongated cylindrical vessel. Such a system is disclosed in U.S. Pat. No. 3,367,121 to Higa, for example.

In Vuilleumier-cycle apparatus, there are often two such vessel/displacer/regenerator systems interconnected such that first ends of the elongated cylindrical vessels are coupled via a conduit. One of the elongated cylindrical vessels is heated at its second end and the other is cold at its second end; thus, the heated vessel is said to have a high-temperature space at its second end and an intermediate temperature space at its first end, while the other vessel is said to have an intermediate temperature space at its first end and a low temperature space at its second end with the two intermediate temperature spaces being interconnected by the conduit. The displacers are interconnected by a linkage which moves them in their respective vessels in an appropriate phase relationship to produce the cooling. The pressure differences across the displacers are small, Hence, very little mechanical power is required to drive the displacers except to overcome small frictional losses. In fact, the heat that is added to the system can in some cases drive the system without applying power to the linkage, except for getting the system started. However, in many cases, small amounts of power must be applied directly to the linkage to keep the system operating. This invention is concerned with providing an appropriate linkage between displacer units.

For further discussions of the Vuilleumier-cycle, as well as the Stirling cycle, and the Gifford-McMahon cycle, the following materials are hereby incorporated by reference: Paper by G. K. Pitcher and F. K. du Pre entitled *Miniature Vuilleumier Cycle Refrigerator* published in ADVANCES IN CRYOGENIC ENGINEERING, Volume 15, page 444 et seq., Plenum Press, New York, 1970; a paper entitled *The Vuilleumier Cycle*, by G. Prast delivered at the Third International Cryogenic Engineering Conference in 1970 and published at page 21 et seq. of the PROCEEDINGS OF THE THIRD INTERNATIONAL CRYOGENIC ENGINEERING CONFERENCE, Berlin, May, 1970, Iliffe Science and Technical Publishing, Ltd., 32 High Street, Guildford, Surrey, United Kingdom, 1970.

A problem that has been encountered with refrigeration apparatus of the type described above, is that moving linkages which move the displacers along the vessels often pass through dynamic seals of the sealed vessels and thereby provide a possible entrance for contaminating materials into the vessels. In addition, some such systems have required bearings and gears located within the cooler working volumes. Such mechanical elements must be lubricated, thus, introducing still other contaminants into the vessels. It is therefore an object of this invention to provide a linkage for moving displacers along refrigeration vessels without providing possible openings for contaminants or requiring contaminants to be introduced into the vessels for lubrication.

In some systems electromagnets are used to control the positions of the displacers in vessels, without having moving linkages passing through the walls of the vessels (see U.S. Pat. No. 3,774,405 to Leo). However, it is difficult for such linkages to obtain positive positional control of the displacers, and they sacrifice the reliability of mechanical linkages.

Some prior art systems involve the use of sealing members for allowing linkage rods, levers and the like to extend into the vessels. Such seals, however often fail and require replacement. Thus, it is yet another object of this invention to provide a durable linkage which requires less maintenance than the linkages of many prior art systems for moving the displacers in the vessels.

It is also an object of this invention to provide a refrigeration system having a displacer linkage which is both efficient, dependable, and economical to manufacture.

SUMMARY

According to principles of this invention, a refrigeration apparatus of the type including a displacer mounted for reciprocal sealing movement in a sealed, elongated working vessel or cylinder has a magnetic-material follower attached to the displacer. A magnetic-material driving element is mounted outside of the sealed elongated working vessel and moveable therealong for magnetically attracting the magnetic-material follower and thereby moving the magnetic-material follower along the working vessel. The magnetic-material follower is attached to the displacer via a rod and, in one embodiment, is actually positioned in an auxiliary portion of the vessel having a smaller diameter and a thinner wall than the working vessel.

In one particular embodiment of the magnetic linkage a magnetic-material driving assembly comprising cylindrically-shaped permanent magnets positioned end-to-end with like poles adjacent one another, but being separated by washer-shaped pole pieces. The washer-shaped pole pieces have greater outside diameters than the permanent magnets, so that they protrude outwardly. The follower is a tubular element surrounding the driving magnet assembly and having internally-protruding flux concentration rings which mate with the pole pieces of the driving magnet assembly. In another similar embodiment the follower is solid and moveable inside a walled vessel located within the magnet assembly.

When used in particular Vuilleumier-cycle refrigeration systems there are magnetic-material followers on both displacers thereof positioned in separate vessels or cylinders and each of these displacers is driven by magnetic-material drivers located outside of the vessels. The magnetic-material drivers are interconnected via an appropriate linkage which is driven by a small motor.

BRIEF DESCRIPTION OF THE DRAWINGS

The foregoing and other objects, features, and advantages of the invention will be apparent from the following more particular description of preferred embodiments of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
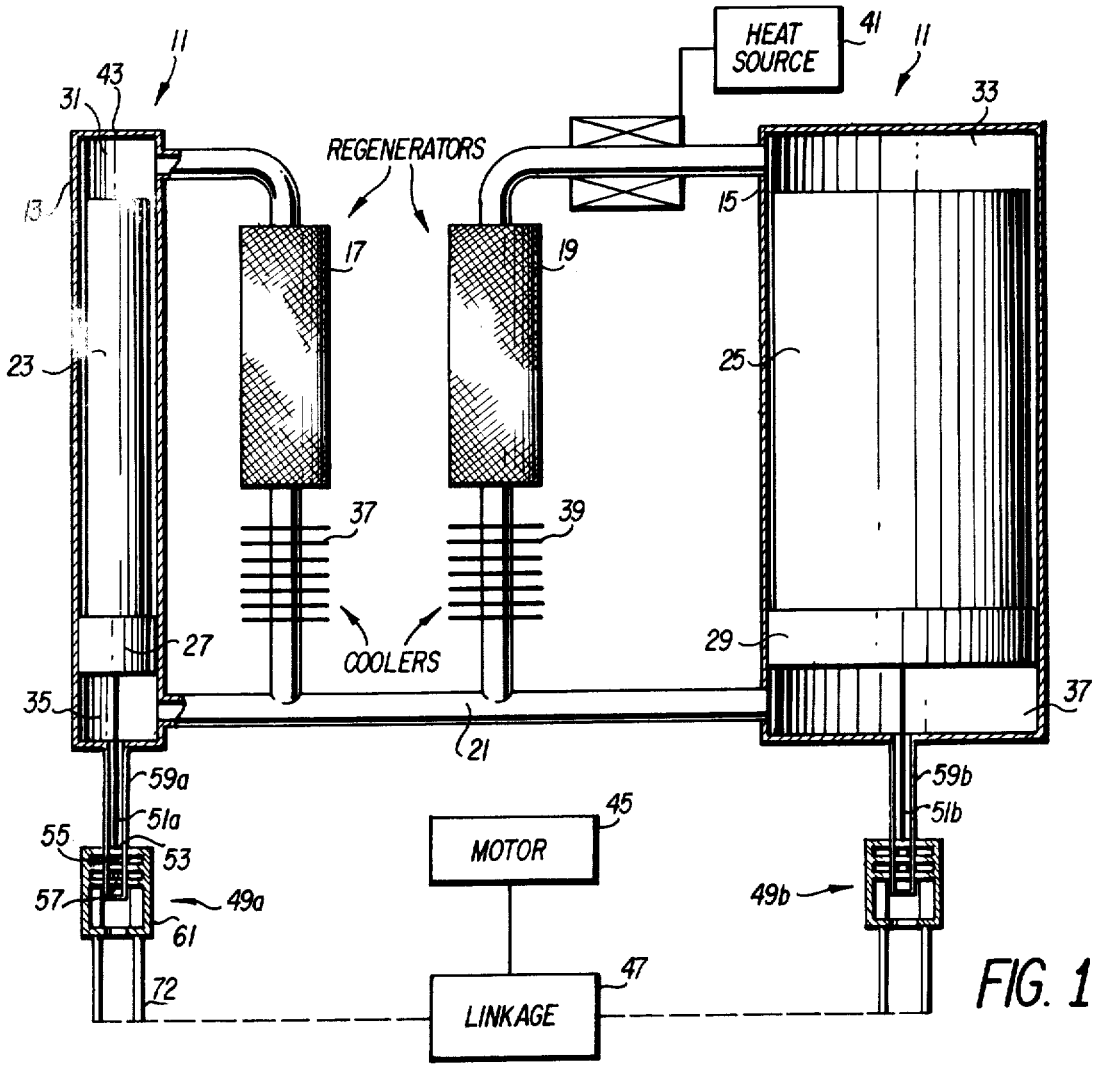
FIG. 1 is a partially cutaway, partially schematic, partially block diagram depicting a Vuilleumier-cycle refrigeration system employing principles of this invention.

Referring to FIG. 1, a sealed working volume 11, is defined by first and second cylindrical working vessels 13 and 15, first and second regenerators 17 and 19, and a connecting conduit 21. First and second displacers 23 and 25 are mounted inside the first and second cylindrical working vessels 13 and 15 and form seals therewith at 27 and 29. A refrigerant such as helium gas fills the working volume 11.

The regenerators 17 and 19 respectively provide communication of variable upper spaces 31 and 33 with the variable lower spaces 35 and 37. The helium gas can flow through them when the first and second displacers 23 and 25 are moved in the cylindrical working vessels 13 and 15. Heat exchange to and from the ambiance can occur at cooling fins 37 and 39. There are no valves.

Heat is added to the system at the top of the second vessel 15 by a heat source 41 and the top of the first vessel 13 is cold. The first and second displacers 23 and 25 are driven by a small motor 45, via mechanical linkage 47 and simplified magnetic linkages 49*a* and *b* (to be described) to reciprocate in the first and second cylindrical working vessels 13 and 15 with a relative phase difference of about 90°.

The simplified magnetic linkages 49*a* and *b* are identical, so only one of these systems will be described for the sake of further simplicity. Each of the displacers 23 and 25 is connected by a straight rod (51*a* or *b*) to a soft iron core 53. The soft iron core 53 has the shape of a cylinder with circumferential grooves 55 therein so as to define one or more radially protruding portions 57. The soft iron core 53 is fitted for easy sliding movement within an auxiliary cylindrical vessel (59*a* or *b*) which communicates with the lower space (35 or 37) of the cylindrical working vessel (13 or 15). The auxiliary vessel (59*a* or *b*) has a thinner wall than the first and second cylindrical working vessels 13 and 15 and it is of a smaller diameter. Further, the auxiliary vessel (59*a* or *b*) is preferably made of a non-magnetic material such as stainless steel.

A permanent magnet 61 (see FIG. 3) having north and south poles 63 and 65 straddles the auxiliary cylindrical vessel (59*a* or *b*) with the north and south poles 63 and 65 on opposite sides thereof. The north and south poles 63 and 65 have radially protruding portions 67 which correspond in spacing to the radially protruding portions 57 of the soft iron core 53. The north and south poles 63 and 65 are connected by a base 69 which has an opening 71 in the middle thereof with a larger diameter than the auxiliary cylindrical vessel (59*a* or *b*).

The permanent magnet 61 is mounted on shafts 72 which are attached to the mechnical linkage 47. The mechnical linkage 47 reciprocates the permanent magnet 61 along the auxiliary cylindrical vessel (59*a* or *b*) and the permanent magnet 61, in turn, attracts the soft iron core 53 to move the soft iron core 53 along with the permanent magnet 61. Since the displacer (23 or 25) is attached to the rod (51*a* or *b*) it is moved along with the soft iron core 53. In this respect, as was mentioned above, the pressure differentials across the displacers 23 and 25 are sufficiently small that magnetic forces are sufficient to move the displacers for the purposes of this type of refrigeration unit. This is especially true since the displacers are moved relatively slowly.

In operation of the FIG. 1 apparatus, the heat source 41 applies heat to the upper end of the second cylindrical working vessel 15 and the displacers 23 and 25 are driven with a relative phase difference of 90° (the first displacer 23 in front of the second displacer 25) by the motor 45, the mechanical linkage 47, and the magnetic linkages 49*a* and *b*. This produces cold at the top of the first cylindrical working vessel 13, with excess heat being dissipated from the cooling fins 37 and 39.

To explain this result, it is noted that the first cylindrical working vessel 13 is very similar to the cylinder of a small Stirling cycle refrigerator. The only thing that is missing is a piston which, in the Stirling cycle operates in the same cylinder but below the displacer. The task of the piston in a Stirling cycle device is to produce a variable pressure having a suitable phase difference with the variations of the cold expansion volumes in the connecting conduit 21. However, no matter how a given pressure variation in the expansion volume is produced, the same cold production will result.

In the Vuilleumier cycle apparatus described herein, the pressure variations in the cold volume are not produced by the motion of a compression piston, but rather by the motion of the second displacer 25 as follows. If the second displacer 25 is "down", much of the helium is in the hot upper space 33, the average helium temperature will be high, and the pressure will be high everywhere in the working volume 11. On the other hand, if the displacer is "up," very little of the helium is in the hot area, the average helium temperature will be low, and the pressure will be low. Therefore, as long as the second displacer 25 moves up and down in the correct phase relationship to the motion of the first displacer 23, the required pressure and volume variations are produced in the cold expansion space and cold is produced at the top 43 of the first cylindrical working vessel 13. It can be shown that a 90° phase difference as described above is suitable, however, this is not necessarily the best choice.

It will be understood by those skilled in the art that by employing the magnetic linkages 49*a* and *b* the entire working volume 11 can remain completely sealed, with no moving parts extending into the system. The force that is required to move the displacers 23 and 25 is slight since the only counter forces on the displacers are due to friction and the pressure drop of helium flowing through the first and second regenerators 17 and 19.

Thus, the magnetic linkages are reliable and uncomplicated. By employing radially protruding portions on the soft iron core 53 and the permanent magnet 61, the follower 53 is retained in a fixed relationship to the permanent magnet 61 so that there is very little "slop" in the linkage. The thin preferably non-magnetic wall of the auxiliary cylinder vessel 59 allows the magnet 61 to be close to the soft iron core 53 so that a strong bond therebetween is created.

Figure 2:
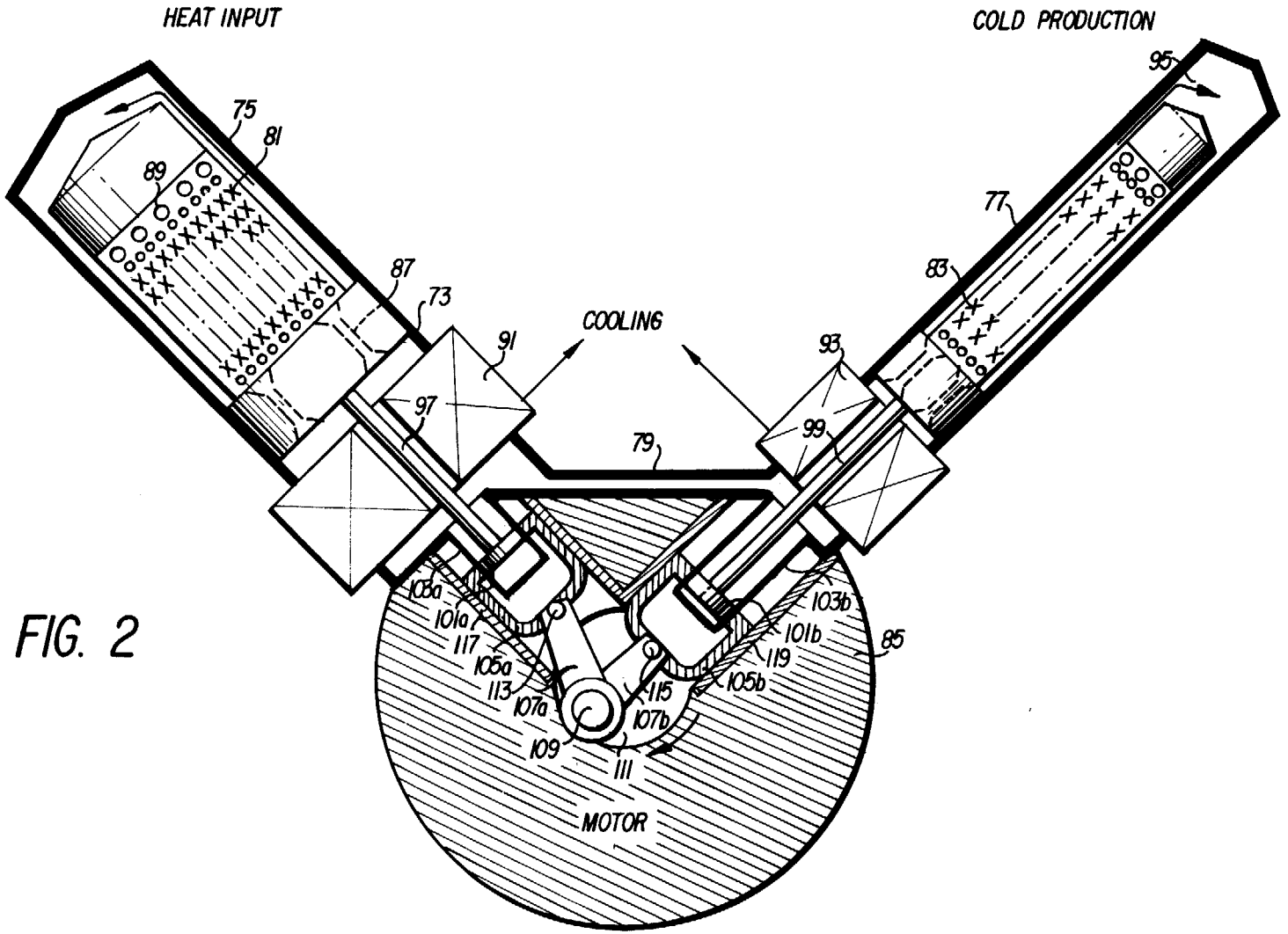
FIG. 2 is a partially cutaway side view of a particular Vuilleumier-cycle refrigeration system employing principles of this invention.

Turning next to the system depicted in FIG. 2, which is basically the same as the FIG. 1 system, the dark outline 73 shows the working volume filled with helium gas. It includes two cylinders 75 and 77 and a connecting conduit 79. Two displacers 81 and 83 are driven by a small electric motor 85 to reciprocate in the first and second cylinders 75 and 77 with a relative phase difference of about 90°. In this embodiment the first and second displacers 81 and 83 are hollow (although they are partly filled with regenerator material). Thus, the displacers 81 and 83 also serve as the regenerators in this system.

The helium gas flows through the displacers 81 and 83, enters the displacers via short channels 87 in the bottoms thereof, passes through the regenerators; and, leaves via the small holes 89 in the tops of the displacers 81 and 83. Helium can then flow via a slit (providing good heat transfer to the outside) to the expansion volume at the top of each of the two cylinders. Heat exchange to the ambiance can also occur from the helium flowing in the space between the two displacers defined by the connecting conduit 79.

Again, heat is added to the top of the first cylinder 75 and the top of the second cylinder 77 is maintained cold. There are no valves.

Also, the second, or cold, cylinder 77 is similar to the cylinder in a Stirling-cycle refrigerator. That is, it includes a cold expansion volume 95 and a regenerator within is the displacer 83. However, instead of using a Stirling-cycle's conventional piston to obtain pressure pulses, the pulses are obtained by the structure of the first cylinder 75 which acts as a thermal pulse generator.

The first and second displacers 81 and 83 are attached to rods 97 and 99, which respectively have soft-iron followers 101*a* and *b* attached to the ends thereof. The soft-iron followers 101*a* and *b* are respectively slideably mounted inside auxiliary cylinders 103*a* and *b* which are sealingly attached to the first and second cylinders to form part of the working volume 73. Permanent magnets 105*a* and *b* are respectively attached to levers 107*a* and *b*. The levers 107*a* and *b* are fixed to one another at an angle of approximately 90°, although they are depicted as being at an angle of something less than 90° in FIG. 2. The levers 107*a* and *b* are mounted on a shaft 109 and are free to rotate thereabout. The shaft 109 is mounted, off center, on a disc 111 which is rotated by the motor 85. The lever 107*a* is pivotally attached to the magnet 105*a* at a pin 113 and the lever 107*b* is pivotally attached to the permanent magnet 105*b* by a pin 115. The permanent magnets 105*a* and *b* are guided to move along linear paths by frames 117 and 119. The poles of the magnets 105*a* and 105*b* are positioned on opposite sides of the soft iron followers 101*a* and *b* but outside of the auxiliary cylinders 103*a* and *b*. As the disc 111 is rotated, the levers 107*a* and *b* cause the permanent magnets 105*a* and *b* to be reciprocated within the frames 117 and 119 in a phase relationship of approximately 90° apart, the permanent magnet 105*b* preceding the permanent magnet 105*a*. Similarly, the soft iron followers 101*a* and *b* are attracted to the poles of the permanent magnets 105*a* and *b* and are thereby moved along with the permanent magnets to drive the displacers 81 and 83, thereby reciprocating these members.

Again, the integrity of the sealed working volume 73 is maintained while providing linkages to displacers within the working volume from without the working volume.

Figure 3:
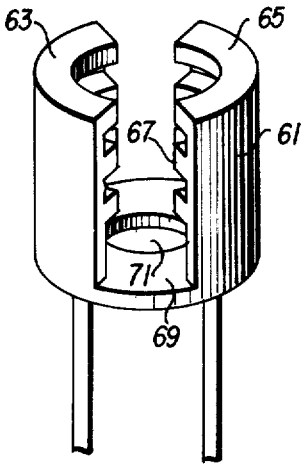
FIG. 3 is an isometric view of the magnetic material driver employed in the FIG. 1 embodiment.
Figure 4:
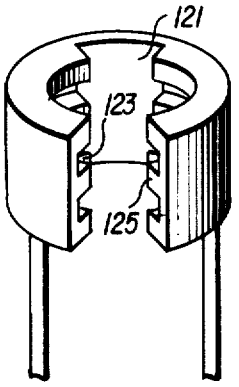
FIG. 4 is an isometric view of a second embodiment of a magnetic-material driver.

Turning to FIG. 4, this drawing depicts another simplified embodiment of the permanent magnet which is similar to the embodiment of FIG. 3, but which does not include the base 69 but rather a sidewall 121 for joining north and south poles 123 and 125.

Figure 6:
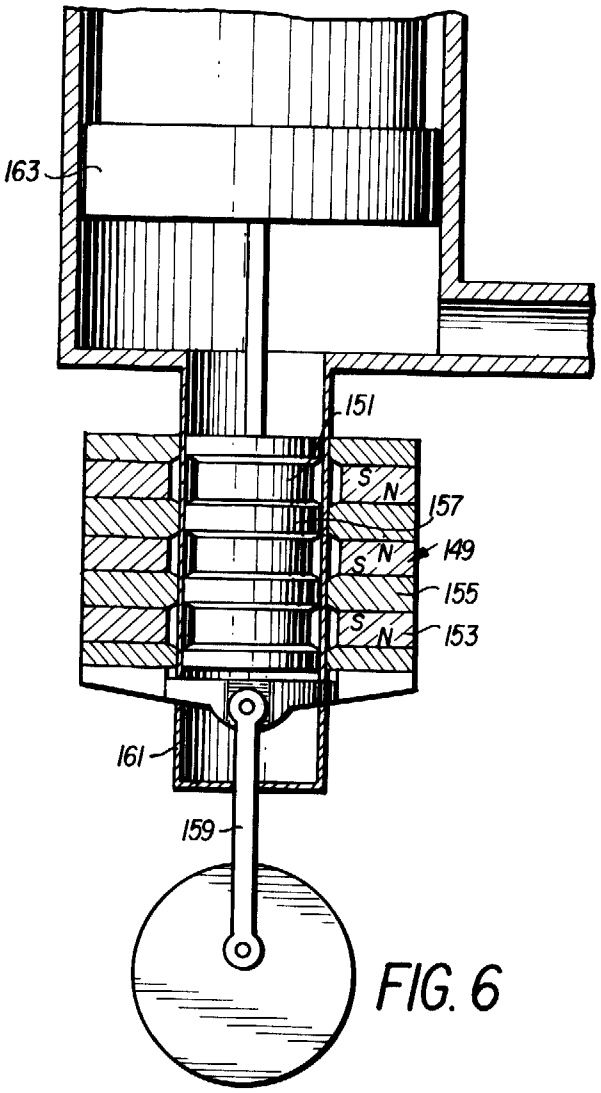
FIG. 6 is a partially cutaway side view of yet another-embodiment magnetic linkage of this invention which is employed in the systems depicted in FIGS. 1 and 2 for example.
Figure 5:
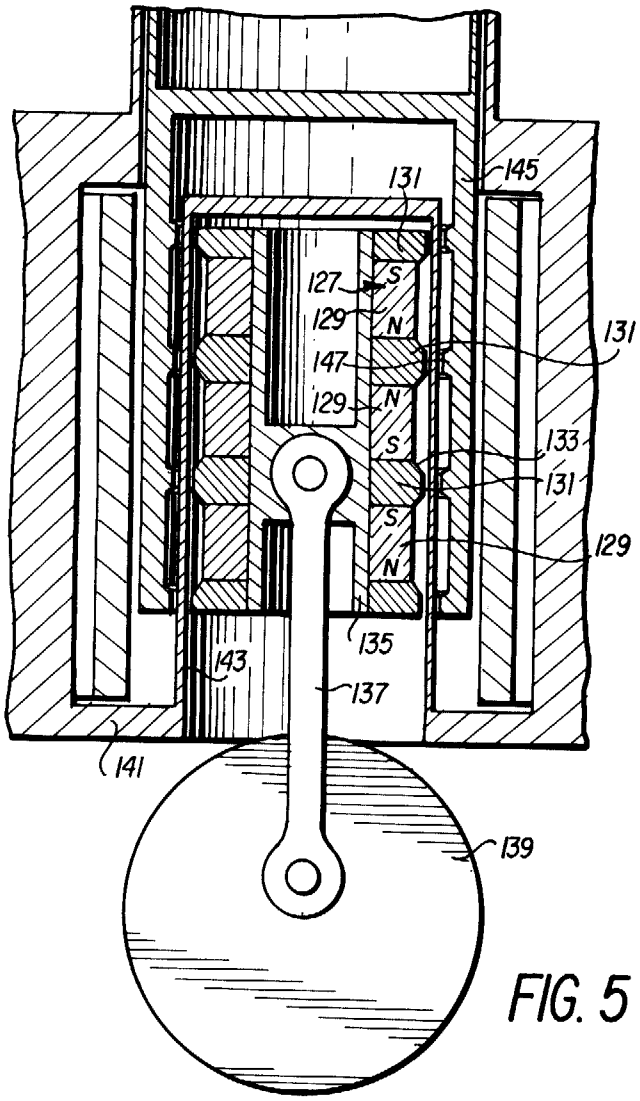
FIG. 5 is a partially cutaway side view of another embodiment magnetic linkage of this invention which is employed in the systems depicted in FIGS. 1 and 2 for example.

Referring now to FIGS. 5 and 6, these drawings depict preferred embodiments of the magnetic-linkage assemblies, although these assemblies are somewhat more complex than the linkages depicted in FIGS. 3 and 4.

In FIG. 5, a magnetic driver 127 includes a plurality of tubularly-shaped permanent magnets 129 having like north/south poles positioned adjacent one another. The tubularly-shaped permanent magnets 129 are separated by washer-shaped pole pieces (of iron, for example) 131 having outer perimeters 133 which protrude beyond the outer surfaces of the tubularly-shaped permanent magnets 129. The inner diameters of the tubularly-shaped permanent magnets 129 and the washer-shaped pole pieces 131 are the same so that these elements can be mounted on a core 135. The core 135 is reciprocally driven by a rod 137 and a driven disc 139 on the outside of a working vessel 141. In this respect, it should be noted that the working vessel 141 defines a hollowed area 143 on the exterior thereof in which the magnetic driver 127 reciprocates. The walls of the hollowed area 143 are thinner than the normal walls of the working vessel 141.

A tubularly shaped soft iron follower 145 surrounds the hollowed area 143 on the interior of the working vessel 141. The soft iron follower 145 has four internally protruding flux concentration rings 147 which mate with the four pole pieces 131 on the magnetic driver 127.

The thin walls of the hollowed area 143 provide a sealed hermetic closure through which the magnetic fields emanating from the north and south poles of the tubularly-shaped permanent magnets 129 passes through the pole pieces 131 and the concentration rings 147 at the four annular locations. When the core 135 is reciprocally driven by the rod 137, the soft-iron follower 145 is also caused to reciprocate along with its attached displacer.

FIG. 6 depicts a similar structure as FIG. 5 with the exception that a magnetic driver 149 is positioned outside of a soft-iron follower core 151. Again, the magnetic drive 149 comprises tubularly shaped permanent magnets 153 and washer-shaped pole pieces 155. However, this time the faces of the pole pieces 155 protrude inwardly rather than outwardly.

The soft-iron driver core 151 has outwardly protruding flux concentration rings 157 which mate with the inwardly protruding disc-shaped pole pieces 155. When the magnetic driver 149 is reciprocally driven by a rod 159 along the outside surface of a vessel 161, the soft-iron driver core 151 is magnetically attracted to be reciprocally moved in the vessel 161 and to, in turn, move an attached displacer 163.

It should be understood by those skilled in the art that the magnetic linkage arrangement depicted in FIGS. 5 and 6 provide efficient use of magnets and pole pieces to get maximum flux concentrations in flux-concentration rings to thereby prevent "slop" between the magnetic driver and the soft-iron follower.

It should be appreciated by those skilled in the art that the magnetic linkage refrigeration systems described herein provide distinct advantages over the prior art systems wherein expensive, relatively unreliable seals were depended on to provide linkages into working volumes of refrigeration systems.

While the invention has been particularly shown and described with reference to preferred embodiments, it will be understood by those skilled in the art that various changes in form and detail may be made therein without departing from the spirit and scope of the invention. For example, the permanent magnets and the magnetic followers could have various shapes and forms. Further, the order could be reversed in that permanent magnets could be attached to the displacer rods and magnetic cores could be attached to the mechnical linkage system. In addition, rather than using soft iron cores, permanent-magnet followers as well as drivers could be used. In addition, it would be possible to use the linkage principles described herein in refrigeration systems other than those employing the Vuilleumier cycle.

The embodiments of the invention in which an exclusive property or privilege are claimed are defined as follows:

1. In a refrigeration apparatus including a displacer mounted for reciprocating sliding movement in a sealed elongated working vessel between first and second positions to alternately effect compression and expansion in said working vessel;

an auxiliary vessel attached to an end of said working vessel and being sealed therewith;

a rod coupled to said displacer and extending into said auxiliary vessel;

a magnetic-material follower attached to said rod in said auxiliary vessel; and a magnetic-material driving means mounted outside said auxiliary vessel but being moveable therealong for magnetically attracting said magnetic-material follower and thereby moving said magnetic-material follower along said auxiliary vessel and said attached displacer along said working vessel.

2. In a refrigeration system as in claim 1 wherein said elongated working vessel and said auxiliary vessel are cylindrical and have substantially circular right-sectional shapes, and said auxiliary vessel is smaller in right-sectional diameter than said working vessel.

3. In a refrigeration apparatus as in claim 2 wherein the walls of said auxiliary vessel are thinner then those of the working vessel.

4. In a refrigeration apparatus as in claim 1 wherein the walls of said auxiliary vessel are thinner then those of the working vessel.

5. In a refrigeration apparatus as in claim 1 wherein said magnetic material follower is soft iron and said magnetic-material driving means is a permanent magnet.

6. In a refrigeration apparatus as in claim 5 wherein said magnetic-material follower is cylindrically shaped but has at least one circumferential groove therein about its outer surface to form a plurality of radially protruding portions and wherein said magnetic-material driver has radially, inwardly, protruding pole-piece portions corresponding to said radially protruding portions of said magnetic-material follower.

7. In a refrigeration apparatus as in claim 1, wherein one of said magnetic material follower or said magnetic material driving means comprises a plurality of permanent magnets arranged in a line with like poles adjacent one another, and pole pieces positioned in said line between said magnets, said pole pieces protruding radially beyond the surfaces of said permanent magnets, and the other of said magnetic material follower or driving means includes protruding flux-concentrating portions which mate with said protruding pole pieces.

8. A Vuilleumier cycle refrigeration system of the type including, a hot unit comprising a first elongated sealed vessel having a first displacer mounted therein with sliding, sealing contact with the inner wall thereof, said first displacer being moveable lengthwise of said first vessel between first and second positions, a cold unit comprising a second elongated sealed vessel having a second displacer mounted therein with sliding, sealing contact with the inner wall thereof, said second displacer being moveable lengthwise of said second vessel between first and second positions, said hot and cold units each including a regenerator means coupled between opposite ends of said elongated sealed vessel for allowing communication between said opposite ends, a coupling means for coupling an end of said first elongated sealed vessel to an end of said second elongated sealed vessel to allow communication therebetween, a refrigerant fluid sealed in said vessels, regenerating means, and said coupling means, a linkage system operatively connected between said first and second displacers for reciprocating said first and second displacers in said respective elongated sealed vessels in a predetermined phase relationship, the improvement wherein said linkage system includes:

a magnetic material follower attached to at least one of said displacers inside its respective elongated sealed vessel; and a magnetic material driver for attracting said magnetic-material follower located adjacent to, but outside said respective elongated sealed vessel and being moveable along said respective elongated sealed vessel in a timed relationship to the movement of the displacer in the other elongated sealed vessel.

9. A Vuilleumier cycle refrigeration system as claimed in claim 8 wherein the movement of said first displacer in said first elongated sealed vessel is approximately 90° ahead of movement of said second displacer in said second elongated sealed vessel.

10. A Vuilleumier cycle refrigeration system as claimed in claim 9 wherein both said first and second displacers have magnetic-material followers attached thereto and there are magnetic material drivers for each, moveably mounted outside of said first and second elongated sealed vessels.

11. A Vuilleumier cycle refrigeration system as claimed in claim 8 wherein both said first and second displacers have magnetic-material followers attached thereto and there are magnetic material drivers for each, moveably mounted outside of said first and second elongated sealed vessels.

12. A Vuilleumier cycle refrigeration system as claimed in claim 11 wherein said first and second elongated sealed vessels include auxiliary vessel portions which are smaller and having thinner walls then the remaining portions thereof, which are made of a nonmagnetic material, and in which said magnetic-material followers are mounted.

13. In a refrigeration apparatus as in claim 11 wherein said magnetic-material follower is cylindrically shaped but has at least one circumferential groove therein about its outer surface to form a plurality of radially protruding portions and wherein said magnetic-material driver has radially, inwardly, protruding pole-piece portions corresponding to said radially protruding portions of said magnetic-material follower.

14. In a refrigeration apparatus as in claim 8 wherein one of said magnetic material follower or driver comprises a plurality of permanent magnets arranged in a line with like poles adjacent one another and pole pieces positioned in said line between said magnets, said pole pieces protruding radially beyond the surfaces of said permanent magnets, and the other of said magnetic-material follower or driver includes protruding flux-concentrating portions which mate with said protruding pole pieces.

15. In a refrigeration apparatus as in claim 8 wherein one of said magnetic material follower or driver comprises a plurality of permanent magnets arranged in a line with unlike poles adjacent one another and pole pieces positioned in said line between said magnets, said pole pieces protruding radially beyond the surfaces of said permanent magnets, and the other of said magnetic-material follower or driver includes protruding flux-concentrating portions which mate with said protruding pole pieces.

* * * * *